US006078827A

United States Patent [19]

Jackson

[11] Patent Number: 6,078,827

[45] Date of Patent: Jun. 20, 2000

[54] MONOLITHIC HIGH TEMPERATURE SUPERCONDUCTOR COPLANAR WAVEGUIDE FERROELECTRIC PHASE SHIFTER

[75] Inventor: Charles M. Jackson, Hawthorne, Calif.

[73] Assignee: TRW Inc., Redondo Beach, Calif.

[21] Appl. No.: 08/879,719

[22] Filed: Jun. 20, 1997

Related U.S. Application Data

[63] Continuation-in-part of application No. 08/427,526, Apr. 24, 1995, abandoned, which is a continuation-in-part of application No. 08/173,548, Dec. 23, 1993, abandoned.

[51] Int. Cl.[7] ..... H01P 1/18; H01B 12/02

[52] U.S. Cl. ..... 505/210; 505/700; 505/701; 505/866; 333/99.005; 333/161

[58] Field of Search ..... 333/995, 161, 333/238, 246; 505/210, 700, 701, 866

[56] References Cited

FOREIGN PATENT DOCUMENTS 1193738 11/1985 U.S.S.R. ..... 333/161

OTHER PUBLICATIONS

Jackson, Charles M.; "Novel Monolithic Phase Shifter Combining Ferroelectric and High Temperature Superconductors"; *Microwave and Optical Technology* Letters; Dec. 20, 1992; pp 722–726.

Withers, R.S. et al; "High Tc Superconducting Thin Films for Microwave Applications"; *Solid State Technology*; vol. 33, No. 8; Aug. 1990; pp 83–87.

*Primary Examiner*—Benny T. Lee
*Attorney, Agent, or Firm*—Michael S. Yatsko

[57] ABSTRACT

A ferroelectric phase shifter in the form of a coplanar waveguide and a method of fabrication thereof in which a ferroelectric film and a high temperature superconductor film are deposited onto a substrate in of a number of configurations. The high temperature superconductor material is biased in order to vary the dielectric constant of the ferroelectric material. Changing the dielectric constant enables varying the amount of phase shift of a wave applied to the phase shifter.

19 Claims, 2 Drawing Sheets

MONOLITHIC HIGH TEMPERATURE SUPERCONDUCTOR COPLANAR WAVEGUIDE FERROELECTRIC PHASE SHIFTER

CROSS-REFERENCE TO PRIOR APPLICATION

This application is a continuation-in-part of U.S. application Ser. No. 08/427,526, filed Apr. 24, 1995, now abandoned which is a continuation-in-part of U.S. application Ser. No. 08/173,548, filed Dec. 23, 1993, now abandoned, and both assigned to the assignee of the present invention.

STATEMENT OF GOVERNMENT SUPPORT

This invention was made with government support under Grant No. N00014-91-C-0199 awarded by the Department of Defense. The government has certain rights in this invention.

BACKGROUND OF THE INVENTION

1. Field of Invention

This invention relates generally to a variable microwave phase shifter using ferroelectric material and high temperature superconducting material to implement variable phase shifting while maintaining relatively low power losses.

2. Discussion

Variable time delay lines or phase shifters are utilized in a wide variety of electronic devices for controlling the phase relationships of signals. One electronic device, a phased array antenna, relies heavily on phase shifters. The phased array antenna generally includes a planar array of radiating elements in an associated array of phase shifters. The radiating elements generate a beam having a planar wave front, and the phase shifters vary the phase front of the beam to control its direction and shape. A typical phased-array antenna may have several thousand elements with a phase shifter for every antenna element. Accordingly, low cost, high reliability, and low complexity of the phase shifters are important design considerations.

Phase shifters may generally be grouped into one of two categories. One category of phase shifter utilizes the variable permeability of ferrites to control the phase shift signals. This type of phase shifter typically includes a thin ferrite rod centered within a rectangular waveguide. A magnetic field applied to the ferrite rod by an induction coil wrapped around the waveguide varies permeability of the ferrite rod, thus controlling the propagation speed, or the phase shift, of signals carried by the waveguide. A second type of phase shifter utilizes varying signal path links to control the phase shift of signals propagating therethrough. Such phase shifters generally include a bank of diodes and various lengths of conductors switched into or out of the signal path by the diodes in order to vary the propagation time or phase shift of signals propagating through the conductors.

U.S. Pat. No. 5,153,171 covers a superconducting variable phase shifter which employs superconducting quantum interference devices (SQUID's) connected in parallel with and distributed along the length of the transmission line. Direct current (DC) control current varies the inductance of the individual SQUID's, thereby distributing inductance of the transmission line in order to control the propagation speed or phase shift of signals carried by the transmission line. The superconducting variable phase shifter provides continuously variable time delay or phase delay over a wide signal band width with relatively low insertion losses and power consumption. However, this apparatus uses superconducting quantum interference devices connected in parallel which requires fabrication of a number of such devices.

Soviet reference SU 1193-738 discusses a microwave phase shifting network having a first gap at least two times larger than a second gap and a complimentary transmission line arrangement. The phase shifter shown in the Soviet reference relies on the superposition of two leaky waves within the gaps in order to generate the phase shift. The Soviet reference, however, fails to take advantage of a co-planer waveguide transmission line structure which controls the propagation velocity in accordance with both the geometry and the dielectric properties of the co-planer waveguide.

SUMMARY OF THE INVENTION

This invention discloses a phase shifter having a dielectric substrate and a film of ferroelectric material having a thickness T. A film of high temperature superconductor material is applied to the ferroelectric film in at least three separate strips, where each strip has a respective width. One of the three strips is a center strip, and the other two strips are outer strips, where the center strip is located between the two outer strips. The center strip has a width narrower than the respective widths of the outer strips, and either the ferroelectric material or the superconductor material is applied to the substrate. The phase shifter has a respective gap G which is defined as the distance between the center strip and the outer strips, where the ratio of G:T is greater than 10 and is less than 100. An electrical biasing means is coupled to the center strip and the outer strips of the high temperature superconductor film for electrically biasing the ferroelectric film.

Additional objects, advantages, and features of the present invention will become apparent from the following description and appended claims, taken in conjunction with the accompanying drawings.

DETAILED DESCRIPTION OF THE INVENTION

Figure 1:
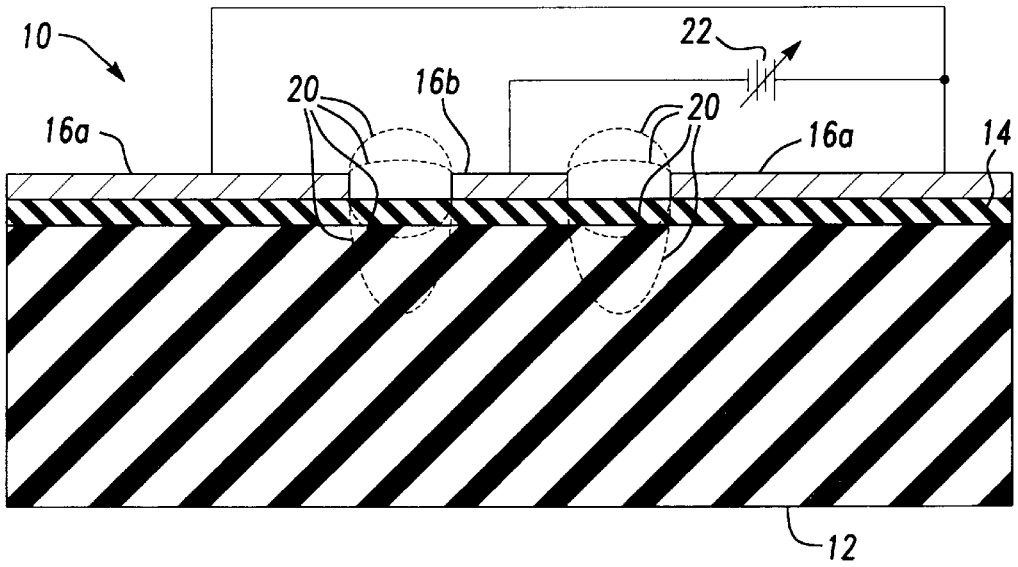
FIG. 1 is a cross-sectional view of a monolithic high temperature superconductor, ferroelectric phase shifter according to this invention implemented in a coplanar waveguide.
Figure 3:
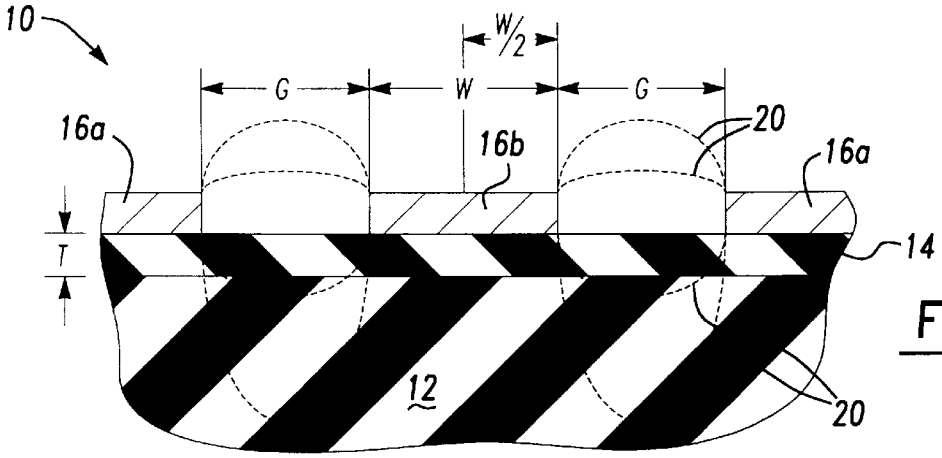
FIG. 3 is an enlarged cross-sectional view of the center conductor section of the ferroelectric phase shifter depicted in FIG. 1.

FIGS. 1 and 3 depict a coplanar waveguide 10 (CPW) geometry for microwave signals which may be implemented in any number of microwave phase control devices. In the CPW 10, a substrate 12 is coated with a ferroelectric layer 14 which is in turn coated with a high temperature superconductor (HTS) material 16*a*, 16*b*. The substrate 12 of FIGS. 1 and 3 comprises $LaAlO_3$. Other materials such as, by way of example only, buffered sapphire, MgO, or buffered yttrium stabilized zirconia, are equally applicable for use as a substrate. Ferroelectric layer 14 has dielectric properties which vary in accordance with a direct-current (DC) bias applied to the HTS material 16*a*, 16*b*. Suitable ferroelectric materials include, by way of example only, $SrTiO_3$ and $Ba_xSr_{1-x}TiO_3$, where x is in the range from 0 to 0.95.

The CPW 10 depicted in FIGS. 1 and 3 has a top layer of HTS material 16*a*, 16*b*, such as, by way of example only, $YBa_2Cu_3O_{7-x}$ (YBCO), where x is in the range from 0 to 1.0, and is preferably for HTS quality, having three separate portions. One portion of HTS material 16*b* is interposed between a second portion of HTS material 16*a* to form a center conductor 16*b* and an outer conductor 16*a*. Such an arrangement is analogous to a coaxial cable having a center conductor and a surrounding shield. The present arrangement functions as a transmission line for electromagnetic pulses transmitted on center conductor 16*b*. Lines 20 (also shown in FIG. 3) represent the electrical field and the flow direction of the electrical field. The shape of field lines 20 denotes the magnitude of the electromagnetic field flowing in center conductor 16*b*. In general, a high dielectric field induced in ferroelectric material 14 results in a greater electric field in center conductor 16*b*.

As seen in FIG. 1, a DC bias is applied using a source of variable DC voltage 22, one terminal of which is electrically coupled to center conductor 16*b* and the other terminal of which is coupled to outer conductors 16*a*. Applying this DC bias results in ferroelectric material 14 having a dielectric constant which varies in accordance with the magnitude of the DC bias applied by DC voltage source 22. Varying the dielectric constant correspondingly varies the phase shift of a wave applied to the phase shifter.

Referring once again to FIGS. 1 and 3, one particularly important feature for implementing the HTS ferroelectric phase shifter embodied as CPW 10 is the geometry of CPW 10 which relates the ferroelectric film 14 thickness T to the gap G or spacing between the HTS films comprising center conductor 16*b* and outer conductors 16*a*, as shown in detail by FIG. 3. In general, the gap G between center conductor 16*b* and outer conductors 16*a* is preferably between 10 to 100 times the thickness T of the ferroelectric film 14. That is, the gap G to ferroelectric thickness T may be expressed as a ratio T/G (or T:G) where $1/10>T/G>1/100$ or $10<G/T<100$. Furthermore, for a CPW, the line width W (See FIG. 3) of center conductor 16*b* is preferably five times greater than the gap G separating center conductor 16*b* and each of the outer conductors 16*a*.

By varying the dielectric constant of ferroelectric material 14, the phase change effectuated by the CPW 10 may be varied accordingly. For example, if the signal transmission path is one centimeter long and center conductor width W is two micrometers and the gap G between center conductor 16*b* and each of the outer conductors 16*a* is four microns, a 150° phase change per centimeter with a 737° maximum phase delay is predicted. For such a configuration, the ohmic insertion loss of 1.4 dB is predicted for copper films, and an insertion loss of 0.014 dB is predicted for the HTS lines. The predicted loss of the HTS line is sufficiently insignificant so that the dielectric loss of the ferroelectric film will compromise a majority of the loss which is about 0.21 dB. If the center conductor 16*b* width W is 33 micrometers wide, a 15° phase shift per centimeter of wave propagation is expected.

Figure 2A:
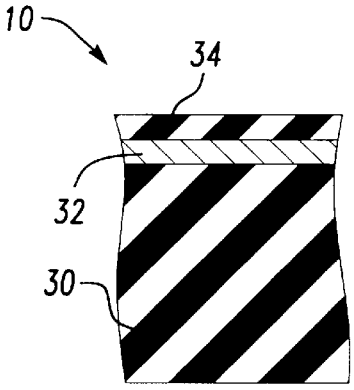
FIGS. 2*a* and 2*b* are a cross-sectional view of a high temperature superconductor, ferroelectric phase shifters having interdigitated capacitors according to a second and third embodiment of the invention, respectively.
Figure 2B:
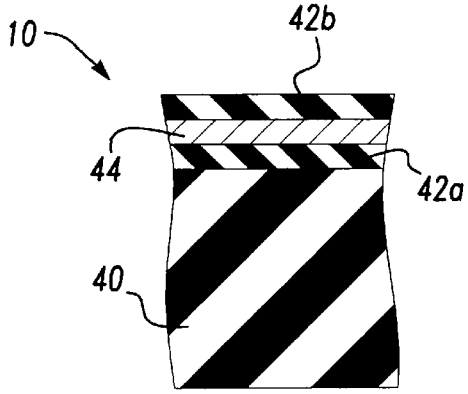

FIGS. 2*a* and 2*b* are partial cross sectional views of a coplanar waveguide 10 depicting alternative configurations of the ferroelectric/HTS interface. In FIG. 2*a*, an HTS film 32 is applied onto a substrate 30. A ferroelectric layer 34 is then applied onto HTS film 32. In FIG. 2*b*, a first ferroelectric layer 42*a* is applied onto a substrate 40. An HTS metallization layer 44 is then applied onto ferroelectric layer 42*a*. HTS metallization layer 44 is then coated with a second ferroelectric layer 42*b*. The substrates 30 and 40, the ferroelectric layers 34, 42*a*, and 42*b*, and the HTS metallization layers 32 and 44 provide properties as described above with respect to FIG. 1 and are similarly arranged in a center conductor/outer conductor fashion as described with respect to FIG. 1.

Figure 4:
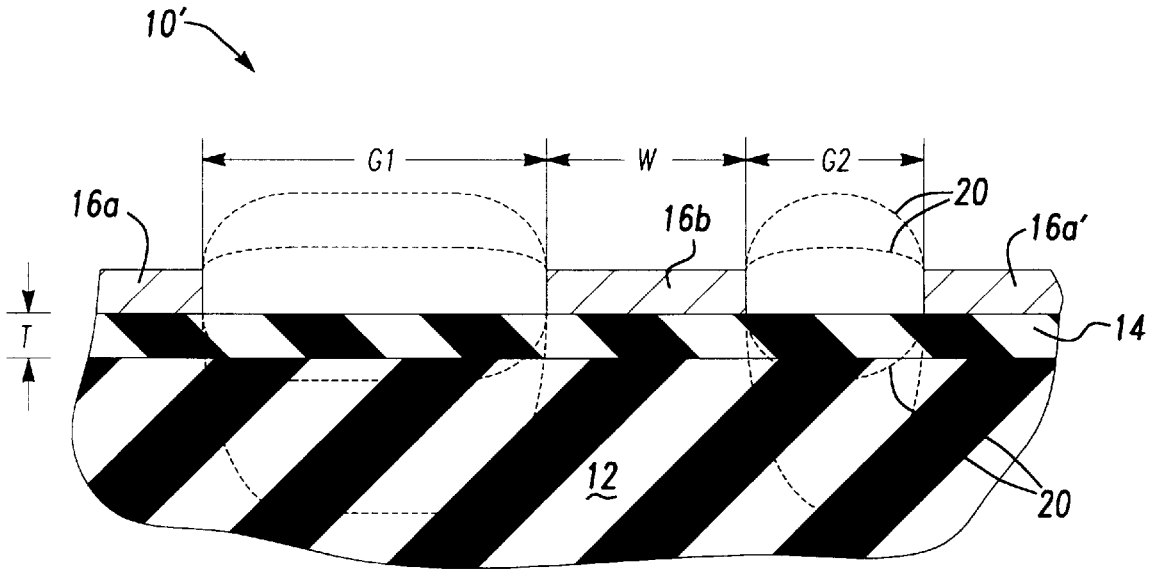
FIG. 4 is a cross-sectional view of the center conductor section of the ferroelectric phase shifter depicted in FIG. 1, but showing an asymmetric arrangement for the high temperature superconducting film.

In a second embodiment of the present invention, FIG. 4 includes a substrate 12 coated with a ferroelectric layer 14 having a thickness T. The ferroelectric layer 14 is coated with a high temperature superconductor (HTS) material 16*a*, 16*b*, 16*a*'. The asymmetric phase shifter 10' creates a field indicated by field lines 20. Operation of the configuration of FIG. 4 may be best understood with reference first to FIG. 3. FIG. 3 depicts a phase shifter 10 having gap spacing G of equal lengths between center conductor 16*b* and outer conductors 16*a*. Such a configuration is defined as a symmetric phase shifter because the configuration is symmetric about the midline of center conductor 16*b* (defined as W/2, where W is the width of center conductor 16*b*). By contrast, FIG. 4 depicts an asymmetric phase shifter 10' where the gap spacing G1 between center conductor 16*b* and a first outer conductor 16*a*, and the gap spacing G2 between center conductor 16*b* and second outer conductor 16*a*' differs. That is, G1 and G2 are not equal. Asymmetric phase shifters provide two distinct advantages to coplanar waveguide design. First, asymmetric phase shifters provide a higher impedance Z and enable the tuning of the impedance Z in accordance with the difference in gap spacing (G1−G2). Further, an asymmetric phase shifter also provides a wider range of tunable capacitances of the phase shifter. Both of the above advantages provide the designers with flexibility in tuning for optimizing the coplanar wave guide.

A method of fabrication of the CPW 10 of FIGS. 1 and 3 will now be described. Substrate 12 is comprised of $LaAlO_3$ onto which is applied via a pulsed laser deposition process, as is well known in the art. Ferroelectric layer 14 comprises $SrTiO_3$ or, alternatively, $Ba_xSr_{1-x}TiO_3$. HTS film 16*a*, 16*b*, comprising $YBa_2Cu_3O_{7-x}$ (YBCO), is deposited onto ferroelectric layer 14 in geometries as depicted in FIG. 1 using a pulsed laser deposition technique. Contact paths (not shown) may be formed by depositing silver using a thermal evaporation and a lift-off process. The samples are then annealed to obtain low Ag-HTS contact resistance. Note that rather than using pulsed laser deposition, other deposition processes such as sputtering, sol-gel, and chemical vapor deposition processes are equally acceptable.

The above described phase shifter 10 offers the advantages of a variable dielectric which may be varied in accordance with the DC bias of a ferroelectric material in combination with the low loss properties of an HTS material. Such a combination provides a relatively low insertion loss as well as higher power transmission capabilities than other HTS phase shifters. Furthermore, a practical amount of phase shift is realizable by implementing the phase shifter 10 as described above. A further advantage is that a phase shifter such as CPW 10 provides more easily matched impedances and greater control over the transmission properties of the waveguide by varying the thickness of the ferroelectric and HTS materials. When phase shifters can be provided with asymmetric properties, tunability is further enhanced and provides system designers with greater flexibility.

Further objects, features, and advantages of the invention will become apparent from a consideration of the following description and the appended claims when taken in connection with the accompanying drawings.

We claim:

1. A phase shifter comprising:

a dielectric substrate;

a film of ferroelectric material having a thickness T defined therewith;

a film of high temperature superconductor material applied to said ferroelectric film in at least three separate strips, each strip having a respective width, one of said at least three strips being a center strip and two others of said at least three strips being outer strips, said center strip being located between the two outer strips, and said center strip having a width narrower than the respective widths of said outer strips, and one of the ferroelectric material and the superconductor material being supported on said substrate, the phase shifter having a respective gap G defined as a distance between the center strip and a corresponding one of the outer strips, where a ratio of G:T is greater than 10 and is less than 100; and electrical biasing means coupled to the center strip and the outer strips of the high temperature superconductor film.

2. The apparatus as defined by claim 1 wherein the electrical biasing means varies an electrical bias between the center strip and the outer two strips, and varying the bias correspondingly varies a resultant phase shift of a wave applied to the phase shifter.

3. The apparatus as defined by claim 1 further comprising:

a first gap G1 defined as a first one of respective gap G; and a second gap G2 defined as a second one of respective gap G and further defined as a distance between the center strip and the corresponding other of the outer strips;

wherein the distances G1 and G2 are equal to define a symmetric phase shifter.

4. The apparatus as defined by claim 1 further comprising:

a first gap G1 defined as a first one of respective gap G; and a second gap G2 defined as a second one of respective gap G and further defined as a distance between the center strip and the corresponding other of the outer strips;

wherein the gaps G1 and G2 represent two distinct distances to define an asymmetric phase shifter.

5. The apparatus as defined in claim 4 where the phase shifter has an impedance which varies in accordance with a difference between the respective distances G1 and G2.

6. The apparatus as defined by claim 1 wherein said ferroelectric film is supported by said substrate.

7. The apparatus as defined by claim 1 wherein said high temperature superconductor film is supported by said substrate.

8. The apparatus as defined by claim 1 wherein the biasing means comprises a variable DC voltage coupled to said center strip and each of said two outer strips of said high temperature superconductor film for varying a dielectric constant associated with said ferroelectric material, thereby varying resultant phase shift.

9. The apparatus as defined by claim 1 wherein said at least three strips cooperate to define a coplanar waveguide phase shifter.

10. The apparatus defined by claim 1 wherein said substrate is selected from the group of $LaAlO_3$, buffered sapphire MgO, and buffered yttrium stabilized zirconia.

11. A coplanar waveguide having a ferroelectric phase shifter comprising:

a dielectric substrate;

a film of ferroelectric material having a thickness T defined therewith;

a film of high temperature superconductor material applied to said ferroelectric film arranged as a center strip positioned between first and second outer strips, and one of the ferroelectric material and the superconductor material being supported on said substrate, a coplanar waveguide having a respective gap G defined as a distance between the center strip and the corresponding one of the first and second outer strips, where a ratio of G:T is greater than 10 and is less than 100; and electrical biasing means coupled to the center and the first and second outer strips of the high temperature superconductor film.

12. The apparatus as defined by claim 11 wherein the electrical biasing means varies an electrical bias between the center strip and the first and second outer strips, and varying the bias correspondingly varies a resultant phase shift of a wave applied to the phase shifter.

13. The apparatus as defined by claim 11 further comprising:

a first gap G1 defined as the respective gap G; and a second gap G2 defined as a second one of the respective gap G and further defined as a distance between the center strip and the corresponding other of the first and second outer strips;

wherein the distances G1 and G2 are equal to define a symmetric phase shifter.

14. The apparatus as defined by claim 12 further comprising:

a first gap G1 defined as a first one of respective gap G; and a second gap G2 defined as a second one of respective gap G and further defined as a distance between the center strip and the corresponding other of the first and second outer strips;

wherein G1 and G2 represent two distinct distances to define an asymmetric phase shifter.

15. The apparatus as defined in claim 14 where the phase shifter has an impedance which varies in accordance with a difference between the respective distances G1 and G2.

16. The apparatus as defined by claim 11 wherein said ferroelectric film is supported by said substrate.

17. The apparatus as defined by claim 11 wherein said high temperature superconductor film is supported by said substrate.

18. The apparatus as defined by claim 11 wherein the biasing means comprises a variable DC voltage coupled across the center strip and the first and second strips of said high temperature superconductor film for varying a dielectric constant associated with said ferroelectric material, thereby varying a resultant phase shift.

19. A method of fabricating a coplanar waveguide, comprising:

providing a substrate;

applying a first film of either a high temperature superconductor material and a ferroelectric material to said substrate, where the ferroelectric material has a thickness T defined therewith;

applying a film of the other of said high temperature superconductor material and ferroelectric material to said first film, the high temperature superconductor material being applied to the ferroelectric in at least three separate strips, each strip having a respective width, one of said at least three strips having a width which is narrower than the respective widths of the other two strips of said at least three strips and being positioned between said corresponding two outer strips of said at least three strips, the waveguide having a respective gap G defined as a distance between the center strip and the corresponding two outer strips, where a ratio of G:T >10 and the ratio of G:T<100; and applying an electrical bias to the center strip and said outer two strips of said high temperature superconductor film.

* * * * *